US009955273B2

(12) United States Patent
Rocca et al.

(10) Patent No.: US 9,955,273 B2
(45) Date of Patent: Apr. 24, 2018

(54) MICROPHONE ASSEMBLY AND METHOD FOR DETERMINING PARAMETERS OF A TRANSDUCER IN A MICROPHONE ASSEMBLY

(71) Applicant: EPCOS AG, Munich (DE)

(72) Inventors: Gino Rocca, Copenhagen (DK); Jan Tue Ravnkilde, Hedehusene (DK)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/301,663

(22) PCT Filed: Apr. 4, 2014

(86) PCT No.: PCT/EP2014/056843
§ 371 (c)(1),
(2) Date: Oct. 3, 2016

(87) PCT Pub. No.: WO2015/149871
PCT Pub. Date: Oct. 8, 2015

(65) Prior Publication Data

US 2017/0118570 A1 Apr. 27, 2017

(51) Int. Cl.

| | |
|---|---|
| ***H04R 29/00*** | (2006.01) |
| ***H04R 1/04*** | (2006.01) |
| ***H04R 3/04*** | (2006.01) |
| *H04R 3/00* | (2006.01) |
| *H04R 19/00* | (2006.01) |

(52) U.S. Cl.
CPC ..... *H04R 29/004* (2013.01); *H04R 1/04* (2013.01); *H04R 3/04* (2013.01); *H04R 3/00* (2013.01); *H04R 19/005* (2013.01)

(58) Field of Classification Search
CPC ..... H04R 29/004; H04R 1/04; H04R 3/00; H04R 3/04; H04R 19/005
USPC ..... 381/58, 59, 91, 94.9, 113, 122, 175
See application file for complete search history.

(56) References Cited

U.S. PATENT DOCUMENTS

| | | | | |
|---|---|---|---|---|
| 3,012,434 | A * | 12/1961 | Wehof | G01H 3/00 73/660 |
| 5,774,626 | A * | 6/1998 | Shenk | B41J 19/205 388/811 |
| 6,980,662 | B1 * | 12/2005 | Gao | A61B 5/121 381/59 |
| 8,675,895 | B2 * | 3/2014 | Hovesten | H04R 29/004 381/111 |
| 2006/0008097 | A1 * | 1/2006 | Stenberg | H04R 3/007 381/113 |
| 2008/0104825 | A1 * | 5/2008 | Dehe | H04R 19/005 29/594 |

(Continued)

FOREIGN PATENT DOCUMENTS

| | | | |
|---|---|---|---|
| WO | 2009127568 | A1 | 10/2009 |
| WO | 2013167183 | A1 | 11/2013 |

*Primary Examiner* — William A Jerez Lora
(74) *Attorney, Agent, or Firm* — Slater Matsil, LLP

(57) ABSTRACT

A microphone assembly is disclosed. In an embodiment, the assembly includes a transducer and an electronic circuit operatively connected to the transducer, wherein the electronic circuit comprises a test mode circuitry configured to selectively set the microphone assembly in one or more test modes or an operational mode, and wherein the one or more test modes enable determining at least one parameter of the transducer.

16 Claims, 1 Drawing Sheet

(56) References Cited

U.S. PATENT DOCUMENTS

| | | | | |
|---|---|---|---|---|
| 2009/0315620 | A1* | 12/2009 | Yamanouchi | H03F 1/0222 330/10 |
| 2012/0205755 | A1* | 8/2012 | Yueh | B81B 7/0061 257/416 |
| 2012/0250910 | A1* | 10/2012 | Shajaan | H04R 1/005 381/174 |
| 2012/0288130 | A1 | 11/2012 | Dehe | |
| 2015/0139453 | A1* | 5/2015 | Akino | H04R 1/04 381/150 |

* cited by examiner

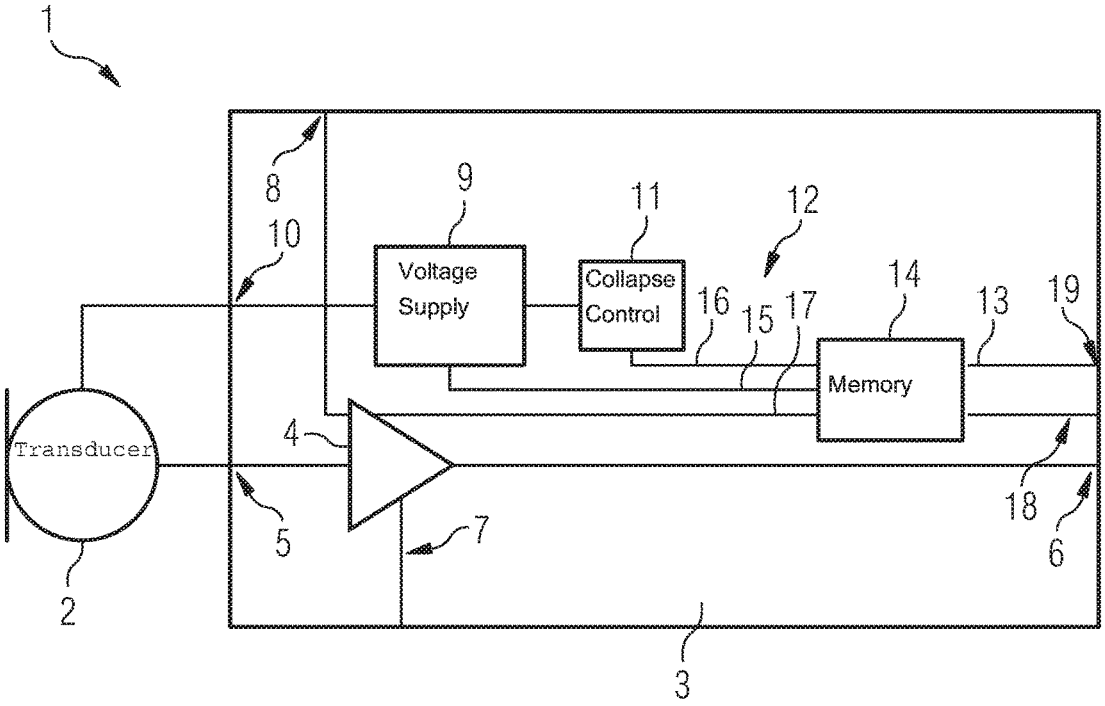
1
8
9
11
12
10
Voltage Supply
Collapse Control
16
15
17
14
13
19
Memory
Transducer
4
5
7
18
6
2
3

MICROPHONE ASSEMBLY AND METHOD FOR DETERMINING PARAMETERS OF A TRANSDUCER IN A MICROPHONE ASSEMBLY

This patent application is a national phase filing under section 371 of PCT/EP2014/056843, filed Apr. 4, 2014, which is incorporated herein by reference in its entirety.

TECHNICAL FIELD

The present invention relates to a microphone assembly, in particular a condenser MEMS microphone assembly, and a method for determining one or more parameters of a transducer in the microphone assembly.

BACKGROUND

Patent application WO 2009/127568 discloses a method for measuring selected performance parameters of a signal processing circuitry of a miniature microphone assembly.

SUMMARY OF THE INVENTION

Embodiments of the invention provide a microphone assembly with improved properties and an improved method for determining at least one parameter of a transducer in a microphone assembly.

Various embodiments provide a microphone assembly. The microphone assembly comprises a transducer for converting an acoustical input signal into an electrical signal. The transducer may be manufactured by application of MEMS (Micro-Electrical-Mechanical Systems) technology. The transducer may comprise a capacitor. In particular, an acoustical input signal may result in a change of capacitance of the transducer. Accordingly, the microphone may be a condenser or capacitor microphone. The transducer may comprise a diaphragm and a back-plate. By an acoustical input, in particular a pressure wave, the diaphragm may be deflected such that the distance between the diaphragm and the back-plate changes, resulting in a change of capacitance of the transducer.

Furthermore, the microphone assembly comprises an electronic circuit operatively connected to the transducer. The electronic circuit may process the signals generated by the transducer. In particular, the electronic circuit may comprise an amplifier. The amplifier may convert a high impedance electrical signal generated by the transducer into a low impedance signal. Moreover, the amplifier may adjust the signal level. The electronic circuit may be an ASIC (application-specific electronic circuit).

For testing or debugging purposes, it may be advantageous to determine one or more parameters of the transducer in the microphone assembly, i.e. at system level. This may be a difficult task, because the output of the microphone assembly is influenced by an interaction and combination of signals generated by the transducer and the electronic circuit, e.g. by the amplifier. In particular, electro-acoustical characterization of the transducer at system level may require precise knowledge of the electronic circuit or may require probing internal nodes between the transducer and the electronic circuit. Also with respect to failure analysis of the microphone assembly it can turn out to be a challenging and time consuming task. Because of the close interaction between its sub-parts, e.g. a MEMS transducer, an ASIC and a substrate, it can be hard to localize the root cause for an observed failure or deviation.

The disclosed microphone assembly comprises a test mode circuitry for selectively setting the microphone assembly in one or more test modes or an operational mode. Each test mode may enable determining at least one parameter of the transducer. In particular, internal nodes of the electronic circuit may be set in the test mode, depending on a specific input signal to the test mode circuitry. The input signal may be provided via a test mode control pin from the outside. This enables a characterization of the transducer at system level, in particular in the final package, without having to disassemble the microphone assembly. In particular, the transducer can be characterized by measuring the output of the microphone assembly for a specific input signal.

The test mode circuitry may be configured for processing an input signal into one or more control signals. Each control signal may control the operation mode of a part of the electronic circuit. In an embodiment, a single control signal may be provided. The control signal may correspond to the input signal. Preferably, the test mode circuitry is configured for processing the input signal into two or more control signals. The control signals may set internal nodes of the electronic circuit. As an example, a control signal may trigger a switch in the electronic circuit. Each control signal may have two possible values, in particular "on" or "off". The operational mode may also correspond to a specific combination of the values of the control signals, in particular all control signals "off".

The test mode circuitry may be designed such that different test modes are available. Each test mode may enable determining a parameter of the transducer. Each test mode may correspond to a specific combination of the values of the control signals. Different values of the input signal may set the microphone in different test modes or in the operational mode. In particular, a specific value of the input signal may be converted into a specific combination of the values of the control signals, corresponding to a specific test mode or to the operational mode.

In an embodiment, the test mode circuitry comprises a memory. The memory may be a non-volatile memory. The memory may comprise an input for receiving a signal from the outside, in particular from a test mode control pin. Depending on the specific input signal, the memory may convert the input signal into one or more control signals as described above.

In an embodiment, the test mode enables determining the signal-to-noise ratio (SNR) of the transducer. In an embodiment, the test mode enables determining the sound pressure level (SPL) at which a collapse of the transducer occurs. In an embodiment, the test mode enables determining the total harmonic distortion (THD) of the transducer as a function of sound pressure level.

The electronic circuit may comprise a voltage supply for the transducer. Thereby, a bias voltage may be applied to the transducer, in particular between a diaphragm and a back-plate of the transducer.

The test mode circuitry may be adapted to provide a control signal for reducing the supplied voltage or setting the supplied voltage to zero. The control signal may be processed from a specific input signal. As an example, the electronic circuit may comprise a short circuiting device to electrically ground an output of the voltage supply, wherein the short circuiting device is triggered by the control signal. In this test mode, the SNR of the transducer may be obtained by measurements on the output.

The electronic circuit may comprise a collapse control for preventing or removing a collapse of the transducer. In a collapse, a diaphragm of the transducer contacts the back-plate. Due to the electrical field provided between the diaphragm and the back-plate, the diaphragm may stick to the back-plate and the transducer may remain in the collapsed state. The diaphragm may be released by reducing the bias voltage between the diaphragm and the back-plate or setting the bias voltage to zero. The collapse control may be configured to trigger reducing the bias voltage or setting the bias voltage to zero at a specific SPL level of the acoustic input. Thereby, a collapse may be prevented or removed.

The test mode circuitry may be adapted to provide a control signal for disabling the collapse control. This test mode may enable determining the SPL at which a collapse of the transducer occurs.

The electronic circuit may comprise an amplifier for processing a signal of the transducer. In particular, the amplifier may convert a high impedance electrical signal generated by the transducer into a low impedance signal.

The test mode circuitry may be adapted to provide a control signal for draining the signal generated by the transducer before the signal is processed by the amplifier. In particular, the control signal may trigger a switch for loading the amplifier input with a capacitor. This test mode may enable determining the THD of the transducer as a function of SPL.

A further aspect of the present disclosure relates to a method of determining at least one parameter of a transducer in a microphone assembly. Features described with respect to the microphone assembly are also disclosed herein with respect to the method and vice versa, even if the respective feature is not explicitly mentioned in the context of the specific aspect.

According to the method, a microphone assembly comprising a transducer, an electronic circuit and a test mode circuitry is provided. The method comprises the step of providing an input signal to the test mode circuitry and thereby setting the microphone assembly in a test mode. In a further step, an output of the electronic circuit is measured. Thereby, a parameter of the transducer may be determined. The method may also include measuring the output of the electronic circuit in an operational mode. For setting the electronic circuit in the operational mode, a specific input signal may be provided. A parameter of the transducer may be determined by comparing the measurement in the operational mode with the measurement in the test mode.

As described above with respect to the microphone assembly, an input signal may be provided to set the microphone assembly in a specific test mode or an operational mode. In an embodiment, two or more test modes may be available. A specific test mode may be selected by the value of the input signal.

The input signal may directly function as a control signal for setting specific parts of the device in a specific operation mode. In an embodiment, the input signal may be processed in one or more control signals. The control signals may be control-bits.

In an embodiment, the input signal triggers reducing the voltage of a voltage supply for the transducer or setting the voltage to zero. In particular, the input signal may be converted into a control signal controlling the operation mode of the voltage supply. A parameter of the transducer may be determined by measuring the noise at the output of the electronic circuit and comparing the resulting value with the noise in an operational mode. In particular, the SNR of the transducer may be obtained.

In an embodiment, the input signal triggers disabling a collapse control of the electronic circuit. In particular, the input signal may be converted into a control signal controlling the operation mode of the collapse control. A parameter of the transducer may be determined by measuring the microphone sensitivity at the output of the electronic circuit and comparing the resulting values with the sensitivity in an operational mode. This test mode may enable determining the sound pressure level at which a collapse of the transducer occurs.

In an embodiment, the input signal triggers draining a signal of the transducer before the signal is processed by an amplifier. In particular, the input signal may be converted into a control signal controlling the operation mode of a capacitor. For example, the control signal may trigger a switch connected to the capacitor. A parameter of the transducer may be determined by measuring the total harmonic distortion as a function of sound pressure level at the output of the electronic circuit. Thereby, the total harmonic distortion of the transducer may be obtained. In this embodiment, the input signal may simultaneously trigger disabling the collapse control. This enables measuring the THD over a large SPL range.

BRIEF DESCRIPTION OF THE DRAWINGS

Further features, refinements and expediencies become apparent from the following description of the exemplary embodiments in connection with the figures.

FIG. 1 shows a simplified block diagram illustrating an embodiment of a microphone assembly.

DETAILED DESCRIPTION OF ILLUSTRATIVE EMBODIMENTS

FIG. 1 shows an embodiment of a microphone assembly 1, in particular a condenser microphone assembly. The microphone assembly 1 comprises a transducer 2, which converts an acoustical input signal into an electrical signal. The transducer 2 is a MEMS transducer. The transducer 2 comprises a diaphragm and a back-plate. On an acoustical input, the diaphragm is deflected towards the back-plate, whereby the capacitance of the transducer changes, which results in an electrical signal.

The microphone assembly 1 further comprises an electronic circuit 3 operatively connected to the transducer 2. In particular, the electronic circuit 3 is fabricated as an ASIC (application-specific electronic circuit). The electronic circuit 3 processes the electrical signals generated by the transducer 2. The circuit 3 comprises an amplifier 4 for transforming a high impedance electrical signal of the transducer 2 into a low impedance output with the correct signal level. The amplifier 4 is connected to an input 5, an output 6, a voltage supply 8, a ground 7 and a line for a control signal 17.

A voltage supply 9 provides a bias voltage 10 applied to the transducer 2, by which the sensitivity of the transducer 2 is adjusted. The voltage supply 9 may comprise a charge pump. A collapse control 11 for preventing and/or detecting a collapse of the diaphragm with the back-plate is connected to the voltage supply 9. The collapse control 11 compares the input signal provided by the transducer 2 with a predefined threshold voltage. At an intended sound pressure level (SPL) the collapse control 11 triggers such that the bias voltage provided by the voltage supply 9 is reduced or completely removed.

The circuit 3 further comprises a test mode circuitry 12 for selectively setting the microphone assembly 1 in one or more test modes or an operational mode. The test mode circuitry 12 comprises an input, which is accessed from the outside by a control pin 19. On a defined input signal 13, the test mode circuitry 12 enters a specific test mode. Thereby, a number of measurements can be made to get information about the transducer 2. Furthermore, the test mode circuitry 12 is provided with a clock signal 18.

The input signal 13 is fed into a memory 14, in particular a non-volatile memory. The memory 14 processes the input signal 13 and provides corresponding control signals 15, 16, 17 to elements of the signal processing circuitry 3. The control signals 15, 16, 17 may be configured as bits, having an "on" or "off" value. Each test mode may correspond to a specific combination of the bits. The operational mode may correspond to each bit having an "off" value.

In a first test mode, a first control signal 15 may be provided to the voltage supply 9. In particular, the first control signal 15 may trigger that the bias voltage 10 provided by the voltage supply 9 is significantly reduced or set to 0 V. Thereby, the sensitivity of the transducer 2 can be set to a negligible value and the noise of the circuit 3 $N_{ASIC}$ can be measured separately on the output 6. By combining this measurement result with the noise $N_{MA}$ of the whole microphone assembly 1 at normal bias voltage, the noise $N_{MEMS}$ of the transducer 2 is calculated as follows: $N_{MEMS}=\mathrm{Sqrt}(N_{MA}^2-N_{ASIC}^2)$. All noise values are referred to resp. measured at the assembly output 6.

Furthermore, the signal-to-noise ratio $SNR_{MEMS}$ of the transducer 2 can be calculated as the ratio between the sensitivity $S_{MEMS}$ of the transducer and the noise $N_{MEMS}$ of the transducer 2, i.e. $SNR_{MEMS}=S_{MEMS}/N_{MEMS}$. Both the noise and the sensitivity of the transducer are measured at the assembly output 6. The sensitivity $S_{MEMS}$ of the transducer 2 is basically the sensitivity $S_{MA}$ of the condenser microphone assembly 1, which can be measured at the output 6.

Accordingly, the SNR of the transducer 2 can be obtained by measurements on the output 6.

In a second test mode, a second control signal 16 may be provided to the collapse control 11. The second control signal 16 may disable the collapse control such that the bias voltage is maintained when the input signal provided by the transducer 2 exceeds the predefined threshold value.

In this mode, the electrical signal at the output 6 as a function of SPL and, thus, the sensitivity of the microphone assembly 1 can be measured. The SPL may be increased until collapse is registered by a reduction in sensitivity. By comparing this measurement result with the one from the microphone assembly 1 where collapse control is enabled, it can be determined whether the triggering of the collapse control 11 is to be attributed to a real diaphragm collapse. In particular, a false triggering of the collapse control 11, i.e. a triggering without a diaphragm collapse, can be identified. This information can also be used to adjust the triggering level of the collapse control 11.

In a third test mode, a third control signal 17 may be provided to the amplifier 4. The third control signal 17 may trigger the amplifier input 5 to be loaded with capacitors that drain the signal from the transducer. Thereby, the overall total harmonic distortion (THD) is dominated by the transducer, and the transducer THD can be characterized as function of SPL. Simultaneously, the collapse control may be disabled by providing the second control signal 16 to the collapse control 11, as described above. This allows a measurement of THD over a large range of SPL levels, in particular also at high SPL levels.

In the first test mode, the first control signal 15 may have an "on" value, while the second and third control signals 16, 17 may have an "off" value. In the second test mode, the second control signal 16 may have an "on" value, while the first and third control signals 15 may have "off" values. In the third test mode, the third and second control signals 17, 16 may have "on" values, while the first control signal 15 may have an "off" value. In the operational mode, all control signals 15, 16, 17 may have "off" values.

The invention claimed is:

1. A microphone assembly comprising:

a transducer; and an electronic circuit operatively connected to the transducer, wherein the electronic circuit comprises a test mode circuitry configured to selectively set the microphone assembly in one or more test modes or an operational mode, wherein the one or more test modes enable determining at least one parameter of the transducer, wherein the electric circuit comprises an input for providing an input signal from an outside of the microphone assembly, and wherein the microphone assembly is configured to be set in one of the test modes or the operational mode depending on a value of the input signal.

2. The microphone assembly of claim 1, wherein the test mode circuitry is configured to process the input signal into two or more control signals, each control signal controlling the operation mode of a part of the electronic circuit.

3. The microphone assembly of claim 1, wherein the test mode circuitry comprises a non-volatile memory for converting the input signal into one or more control signals.

4. The microphone assembly of claim 1, wherein a test mode is configured to determine a signal-to-noise ratio of the transducer.

5. The microphone assembly of claim 1, wherein the electronic circuit comprises a voltage supply for the transducer, and wherein the test mode circuitry is adapted to provide a first control signal for reducing a supplied voltage or setting a supplied voltage to zero.

6. The microphone assembly of claim 1, wherein a test mode is configured to determine a sound pressure level at which a collapse of the transducer occurs.

7. The microphone assembly of claim 1, wherein the electronic circuit comprises a collapse control for preventing or removing a collapse of the transducer, and wherein the test mode circuitry is adapted to provide a second control signal for disabling the collapse control.

8. The microphone assembly of claim 1, wherein a test mode is configured to determine a total harmonic distortion of the transducer as a function of a sound pressure level.

9. The microphone assembly of claim 1, wherein the electronic circuit comprises an amplifier for processing a signal of the transducer, and wherein the test mode circuitry is adapted to provide a third control signal for triggering an amplifier input to be loaded with capacitors that drain the signal of the transducer before the signal of the transducer is processed by the amplifier.

10. A method of determining at least one parameter of a transducer in a microphone assembly, the microphone assembly comprising the transducer and an electronic circuit operatively connected to the transducer and the electronic circuit comprising a test mode circuitry, wherein the electric circuit comprises an input for providing an input signal from an outside of the microphone assembly, and wherein the microphone assembly is configured to be set in one or more test modes or an operational mode depending on a value of the input signal, the method comprising:

providing the input signal to the test mode circuitry;

setting the microphone assembly selectively in the one or more test modes or in the operational mode; and measuring an output signal of the electronic circuit.

11. The method of claim 10, wherein the electronic circuit comprises a voltage supply for the transducer, and wherein the input signal triggers reducing a voltage or setting a voltage to zero.

12. The method of claim 11, wherein measuring the output signal comprises measuring a first noise value at an output port of the electronic circuit and comparing the first noise value with a second noise value of an operational mode.

13. The method of claim 10, wherein the electronic circuit comprises a collapse control for preventing or removing a collapse of the transducer, and wherein the input signal triggers disabling the collapse control.

14. The method of claim 13, wherein measuring the output signal comprises measuring a value of a microphone sensitivity as a function of a sound pressure level at an output port of the electronic circuit and comparing the value with a sensitivity value in an operational mode.

15. The method of claim 10, wherein the electronic circuit comprises an amplifier for processing a signal of the transducer, and wherein the input signal triggers an amplifier input to be loaded with capacitors that drain the signal of the transducer before the signal of the transducer is processed by the amplifier.

16. The method of claim 15, wherein measuring the output signal comprises measuring a total harmonic distortion as a function of a sound pressure level at an output port of the electronic circuit.

* * * * *